US012085344B2

(12) United States Patent
Li et al.

(10) Patent No.: US 12,085,344 B2
(45) Date of Patent: Sep. 10, 2024

(54) BOILING ENHANCEMENT DEVICE

(71) Applicant: SMARTH TECHNOLOGY LTD., Zhuzhou (CN)

(72) Inventors: Chun Li, Zhuzhou (CN); Guangfan Hu, Zhuzhou (CN); Chunhong Yao, Zhuzhou (CN); Qiucheng Ma, Zhuzhou (CN)

(73) Assignee: SMARTH TECHNOLOGY LTD., Zhuzhou (CN)

( * ) Notice: Subject to any disclaimer, the term of this patent is extended or adjusted under 35 U.S.C. 154(b) by 119 days.

(21) Appl. No.: 17/426,179

(22) PCT Filed: Dec. 17, 2019

(86) PCT No.: PCT/CN2019/125970
§ 371 (c)(1),
(2) Date: Jul. 28, 2021

(87) PCT Pub. No.: WO2020/155901
PCT Pub. Date: Aug. 6, 2020

(65) Prior Publication Data

US 2022/0099382 A1 Mar. 31, 2022

(30) Foreign Application Priority Data

Jan. 29, 2019 (CN) ..... 201910086237.9

(51) Int. Cl.
*F28D 15/02* (2006.01)
*F28D 15/04* (2006.01)
*F28F 3/02* (2006.01)

(52) U.S. Cl.
CPC ..... *F28D 15/0233* (2013.01); *F28D 15/046* (2013.01); *F28F 3/027* (2013.01)

(58) Field of Classification Search
CPC ... F28F 3/025; F28F 3/027; F28D 2021/0064; F28D 15/0233; F28D 15/046
See application file for complete search history.

(56) References Cited

U.S. PATENT DOCUMENTS 4,944,344 A * 7/1990 Crowe ..... F28F 3/027 361/698
6,216,343 B1 * 4/2001 Leland ..... F28D 15/04 29/890.032

(Continued)

FOREIGN PATENT DOCUMENTS

CN 100583419 C 1/2010
CN 202885616 U 4/2013

(Continued)

OTHER PUBLICATIONS

PCT International Search Report dated Mar. 10, 2020 in connection with PCT/CN2019/125970.

(Continued)

*Primary Examiner* — Tho V Duong
(74) *Attorney, Agent, or Firm* — Amster, Rothstein & Ebenstein LLP

(57) ABSTRACT

The present invention discloses a boiling enhancement device which comprises an evaporation chamber having a cavity therein and boiling enhancement fins, the boiling enhancement fins are arranged on an inner wall surface of the evaporation chamber, a phase-change heat exchange medium is arranged in the evaporation chamber, and the evaporation chamber absorbs heat from a heat source and transfers the heat to the phase-change heat exchange medium through the inner wall surface. The boiling enhancement fins can increase the number of vaporization cores on the inner wall of the evaporation chamber and increase the area of boiling heat exchange so as to promote boiling vaporization of the phase-change heat exchange (Continued)

medium and reduce boiling thermal resistance. The boiling enhancement device has the following advantages that, the boiling enhancement fins are densely arranged, so that the heat exchange area is maximized, and the thermal resistance of boiling heat transfer is reduced; the boiling enhancement fins are provided with densely distributed holes or windows, so that the number of bubble cores is greatly increased, the diameter of the bubbles is reduced, the bubbles are more easily formed, and thus the heat exchange thermal resistance is reduced.

7 Claims, 2 Drawing Sheets

(56) References Cited

U.S. PATENT DOCUMENTS

| | | | | |
|---|---|---|---|---|
| 6,293,333 | B1 * | 9/2001 | Ponnappan | F28D 15/0233 29/890.032 |
| 6,397,935 | B1 * | 6/2002 | Yamamoto | F28D 15/0233 257/E23.098 |
| 8,316,921 | B2 | 11/2012 | Hou et al. | |
| 10,201,119 | B2 * | 2/2019 | Pal | H05K 7/20154 |
| 2003/0159806 | A1 * | 8/2003 | Sehmbey | F28D 15/046 257/E23.088 |
| 2004/0050538 | A1 * | 3/2004 | Sunder | F25J 5/002 165/DIG. 360 |
| 2004/0196633 | A1 | 10/2004 | Wong | |
| 2005/0141195 | A1 * | 6/2005 | Pokharna | H01L 23/427 257/E23.098 |
| 2006/0213211 | A1 | 8/2006 | Shah et al. | |
| 2014/0054014 | A1 * | 2/2014 | Dai | F28D 15/046 264/108 |
| 2019/0072303 | A1 * | 3/2019 | Moghaddam | F28F 13/182 |

FOREIGN PATENT DOCUMENTS

| | | | |
|---|---|---|---|
| CN | 203586895 | U | 5/2014 |
| CN | 104864755 | A | 8/2015 |
| CN | 205425915 | U | 8/2016 |
| CN | 109883227 | A | 6/2019 |
| CN | 209877719 | U | 12/2019 |
| JP | 2005093467 | A | 4/2005 |
| WO | 2006074583 | A1 | 7/2006 |

OTHER PUBLICATIONS

PCT Written Opinion dated Mar. 10, 2020 in connection with PCT/CN2019/125970.

Extended European Search Report issued in Application No. 19913972.6, dated Jan. 19, 2022.

* cited by examiner

BOILING ENHANCEMENT DEVICE

CROSS-REFERENCE TO RELATED APPLICATIONS

This application is a U.S. national stage entry under 35 U.S.C. § 371 of PCT International Patent Application No. PCT/CN2019/125970, filed Dec. 17, 2019, which claims priority to Chinese Patent Application No. 2019100862237.9, filed Jan. 29, 2019, the contents of which are incorporated herein by reference in their entirety.

TECHNICAL FIELD

The present invention pertains to the technical field of heat exchange devices, and particularly related to an boiling enhancement device for an electronic device.

BACKGROUND

Phase-change heat dissipation is increasingly popularized as a highly efficient way of heat dissipation, the principle of phase-change heat dissipation is that a phase-change medium is used for boiling, gasifying and absorbing heat at a certain temperature, and then gasified gas is condensed and liquefied at other sites to release heat, so that heat transfer is achieved. Phase-change heat dissipation is widely used because of its good heat transfer effect. The evaporation and gasification stage is the key stage of the phase-change heat transfer process, and the heat transfer efficiency directly affects the phase-change heat transfer effect.

In order to improve the heat transfer efficiency and enhance the boiling heat exchange effect, the principle for enhancing the boiling heat exchange effect mainly includes increasing the number of boiling bubble cores, increasing the heat exchange area and avoiding the phenomenon of excessive boiling. Wherein, the methods for changing the heat transfer surface structure mainly adopted at present include mechanical machining, laser etching, chemical etching, sintering, etc. To enhance the boiling heat transfer, channels, protruding structures and porous surfaces are set on the heat transfer surface to increase the heat transfer area and promote the formation of bubble cores.

The porous surface processed by the mechanical machining method is relatively good in effect, but the number of bubble cores increased by this method is limited, pores below 0.1 mm are difficult to process, and the phenomenon of excessive boiling is easy to occur along with the increase of the heat flux density, which would reduce the heat transfer capacity in addition, the mechanical machining method is of high processing cost and long manufacturing cycle, which cannot meet the requirements of large-scale and efficient production.

The number of bubble cores can be well increased by means of metal sintering, but the sintered pores would affect the thermal conductivity of the material, thus affects the effective heat transfer area. There are foreign substance residues remaining in the sintering process, which would affect the performance of the phase-change medium.

Laser etching and chemical etching have some disadvantages, such as limited etching depth, insufficient heat transfer area, and that it is easy for the excessive boiling phenomenon to occur.

Therefore, it is necessary to design a boiling enhancement device with low boiling heat transfer thermal resistance, high heat flux density, low production cost and high production efficiency in the field.

SUMMARY OF THE INVENTION

In order to solve the problems in the prior art as described above, the present invention provides a boiling enhancement device.

In order to achieve the above objective, the specific technical solution of the boiling enhancement device of the present invention is as follows:

An boiling enhancement device comprises an evaporation chamber having a cavity therein and boiling enhancement fins, the boiling enhancement fins are arranged on an inner wall face of the evaporation chamber, a phase-change heat exchange medium is arranged in the evaporation chamber, and the evaporation chamber absorbs heat from a heat source and transfers the heat to the phase-change heat exchange medium through the inner wall surface. The boiling enhancement fins can increase the number of vaporization cores on the inner wall surface of the evaporation chamber and increase the area of boiling heat transfer, so as to promote boiling vaporization of the phase-change heat exchange medium and reduce boiling thermal resistance.

Furthermore, the boiling enhancement fins comprise a plurality of sawtooth or wavy strip-shaped cooling fins arranged on the inner wall surface of the evaporation chamber.

Furthermore, the strip-shaped cooling fins are composed b gathering a plurality of sawtooth sheets or wave sheets, the sawtooth pitch of a minimum repeating unit among the sawtooth strip-shaped cooling fins is smaller than 1 mm, and the thickness of each of the sawtooth sheets is smaller than 0.2 mm.

Furthermore, the sawtooth pitch of the minimum repeating unit among the sawtooth strip-shaped cooling fins is 0.0001 mm-1 mm, and the thickness of each of the sawtooth sheets is 0.01 mm-0.2 mm.

Furthermore, perforated or windowed structures are formed on the boiling enhancement fins.

Furthermore, the boiling enhancement fins are brazed to the inner wall surface of the evaporation chamber.

Furthermore, the sawtooth strip-shaped cooling fins are triangular sawtooth or rectangular sawtooth strip-shaped cooling fins.

Furthermore, the plurality of strip-shaped cooling fins are arranged in parallel on the inner wall surface of the evaporation chamber, the boiling enhancement device further comprises an air-cooled radiating assembly, and the channel direction of the parallel arrangement of the plurality of strip-shaped cooling fins is perpendicular to the air flow direction of the air-cooled radiating assembly.

Furthermore, an outer wall surface of the evaporation chamber is in contact with the heat source, and the thickness of the side wall of the evaporation chamber in contact with the heat source is smaller than 2 mm.

Furthermore, the outer surface of the wall of the evaporation chamber is provided with a contact heat absorption surface, the heat source is provided with a heat source surface, and the contact heat absorption surface of the evaporation chamber is in contact with the heat source surface of the heat source.

The boiling enhancement device is efficient in heat exchange and low in production and processing cost, and mainly has the following advantages:

1) The boiling enhancement fins with a dense arrangement are used to maximize the heat transfer area and reduce the thermal resistance of boiling heat transfer;
2) The densely distributed holes or windows on the boiling enhancement fins greatly increase the number of bubble cores, that is, increase the number of boiling cores, reduce the diameter of the bubbles, and form bubbles more easily, so as to reduce the heat transfer thermal resistance.
3) By means of the densely distributed holes or windows, the size of the bubbles can be effectively controlled, a steam column is prevented from being formed, an unstable air film is prevented from being formed on the wall surface, so that the phenomenon of excessive boiling is avoided, the heat flux density of boiling heat transfer is improved, and the capillary force of the phase-change heat exchange medium is increased;
4) The boiling enhancement fins and the evaporation chamber are connected into a whole by brazing, so that the contact thermal resistance between the fins and the evaporation chamber body is reduced;
5) Compared with processing methods such as mechanical machining, laser etching and chemical etching, the brazing process is of high efficiency, low cost and high maturity, which is suitable for large-scale production.

DETAILED DESCRIPTION OF EMBODIMENTS

Figure 1:
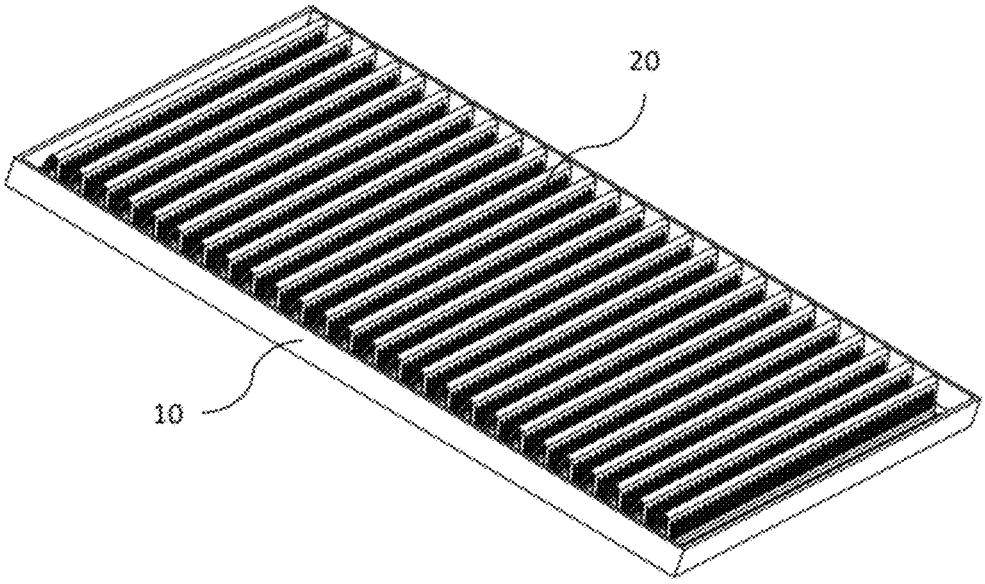
FIG. 1 is a perspective view of a boiling enhancement device of the present invention.
Figure 2:
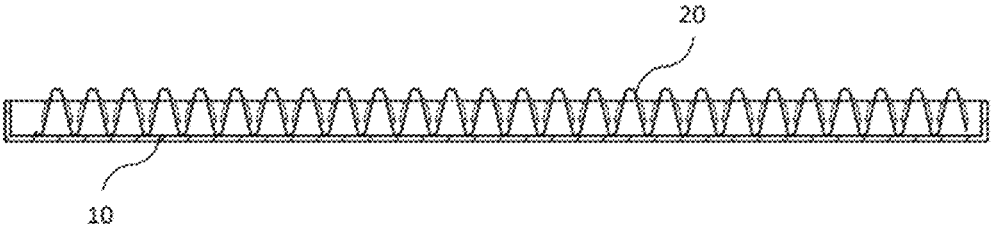
FIG. 2 is an enlarged view of the boiling enhancement device of the present invention.
Figure 3:
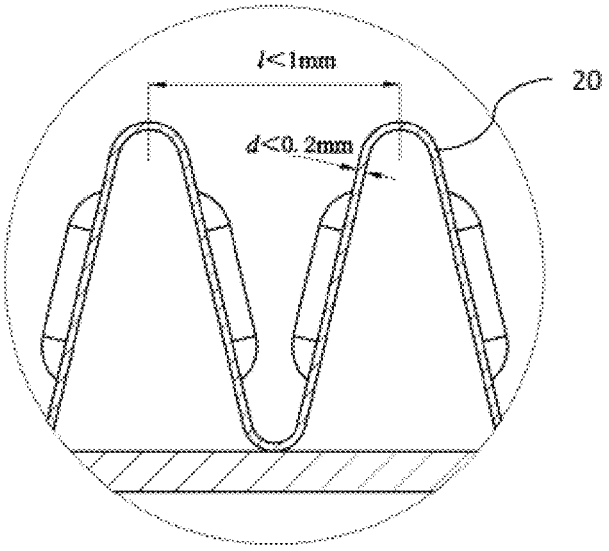
FIG. 3 is a top view of the boiling enhancement apparatus of the present invention.
Figure 4:
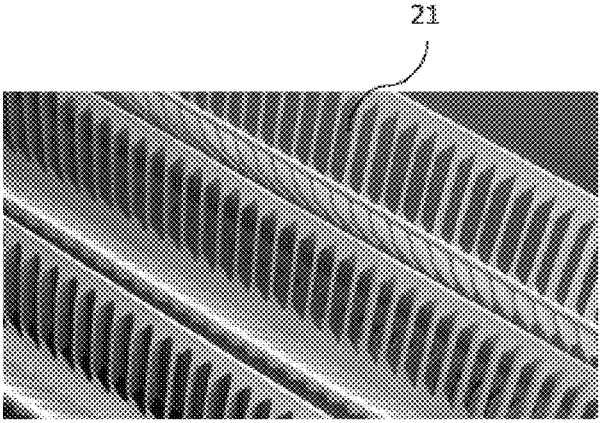
FIG. 4 shows the windowed structures in a boiling enhancement device of the present invention.

In order to better understand the purpose, the structure and the function of the present invention, the enhancement device of the present invention is described in more details below in conjunction with the accompanying drawings.

The relevant terms in the present invention are explained as follows:

Boiling heat transfer refers to the heat transfer process wherein heat is transferred to liquid from a wall surface so that the liquid is boiled and vaporized.

Vaporization core: the vaporization core is a carrier that initiates liquid boiling.

Thermal conductivity is defined as that, when two parallel planes with a distance of 1 meter and an area of 1 square meter each are taken perpendicular to the direction of heat conduction inside an object, and if the temperatures of the two planes differ by 1 K, the amount of heat conducted from one plane to the other plane in 1 second is defined as the thermal conductivity of the substance in Watt*$m^{-1}$*$K^{-1}$ ($W \cdot m^{-1} \cdot K^{-1}$).

Thermal resistance is defined as the ratio between the temperature difference across an object and the power of a heat source in Kelvin per Watt (K/W) or degrees Celsius per Watt (° C./W) when heat is transferred across the object.

Heat transfer coefficient refers to the heat transferred through a unit area in unit time under a stable heat transfer condition wherein the temperature difference of air on two sides of the enclosure structure is 1 degree (K or ° C.), the unit thereof is watt/(square meter*degree) (W/$m^2$*K, where K can be replaced by ° C.), and the intensity of the heat transfer process is reflected by it.

Heat flux density: the amount of heat transferred through a unit area in a unit time is called the heat flux density, q=Q/(S*t). Here, Q is the amount of heat t is the time, S is the cross-sectional area, and the unit of heat flux density is J/($m^2 \cdot s$).

Excessive boiling: when the heat flux density is increased, steam sprayed from a large number of vaporization cores forms a steam column, and the liquid supply to the heat transfer surface is hindered by the steam flow, so that the liquid is dried on the heat transfer surface in a short time, which causes the temperature of the heat transfer surface to be rapidly increased.

The boiling enhancement device of the present invention comprises an evaporation chamber 10 and boiling enhancement fins 20, and the evaporation chamber 10 can be a plate-shaped chamber with a cavity in the middle and can also comprise a plurality of sub-cavities which are communicated with one another. The boiling enhancement fins 20 are arranged in the evaporation chamber 10, that is, the boiling enhancement fins 20 are connected to an inner wall surface of the evaporation chamber 10, and an outer side surface of the side wall, connected with the boiling enhancement fins 20, of the evaporation chamber 10 is in contact with a heat source so as to absorb heat from the heat source. A phase-change heat exchange medium is arranged in the evaporation chamber 10, the phase-change heat exchange medium in the evaporation chamber 10 is boiled and gasified after absorbing heat from the heat source, and the boiling enhancement fins 20 can significantly increase the number of boiling and gasifying cores on the side wall of the evaporation chamber 10, increase the heat transfer area and promote boiling and gasifying of the phase-change heat exchange medium.

The boiling enhancement fins 20 comprise a plurality of sawtooth strip-shaped cooling fins or wavy strip-shaped cooling fins, such as triangular sawtooth or rectangular sawtooth strip-shaped cooling fins, or S-shaped wavy strip-shaped cooling fins, arranged on the inner wall surface of the evaporation chamber 10, and the plate surfaces of the boiling enhancement fins 20 extend in a direction perpendicular to the inner surface of the evaporation chamber 10, so as to facilitate dissipating heat outwards. The boiling enhancement fins 20 may be made of copper, aluminum, copper alloys, aluminum alloys, stainless steel, or the like.

The plurality of sawtooth strip-shaped cooling fins are arranged in parallel on the inner surface of the side wall of the evaporation chamber 10, for the situation including air cooling heat dissipation, the channel direction of the parallel arrangement of the plurality of sawtooth strip-shaped cooling fins is perpendicular to the air flow direction, and the plurality of sawtooth strip-shaped cooling fins are evenly arranged at uniform intervals to ensure that fluid evenly flows on the boiling enhancement fins 20. And the plurality of sawtooth strip-shaped cooling fins can be arranged in a staggered tooth manner.

The sawtooth strip-shaped cooling fins comprise a plurality of sawtooth fins or wavy fins, the sawtooth fins can, for example, be in a triangular sawtooth shape or a rectangular sawtooth shape, the wavy fins are in an arc-shaped wavy shape with smooth transitions, and the sawtooth fins and the wavy fins are densely arranged to form a boding enhancement structure. The pitch between every two adjacent sawtooth pieces (the distance between every two adjacent corresponding wave crest positions) is smaller than 1 mm, such as 0.0001 mm-1 mm, that is, the sawtooth pitch of the minimum repeating unit thereof is smaller than 1 mm, so that the heat exchange area is increased, the thickness of each of the sawtooth pieces or each of the wave pieces is smaller than 0.2 mm, such as 0.01 mm-0.2 mm, the porosity of the sawtooth strip-shaped cooling fins is smaller than 60%, such as 10%-60%, and because the sawtooth or wavy strip-shaped cooling fins are densely arranged, at the same time of promoting the vaporization boiling, the difficulty of forming a follow-up boiling core is reduced by the arrangement of the sawtooth shape or the wave shape.

Perforated or windowed structures 21 can be formed in the sawtooth pieces, which can destroy a thermal boundary layer to improve the heat transfer performance, thus the heat transfer coefficient of the boiling enhancement fin 20 is improved, and the heat exchange effect is enhanced. The through holes in the perforated structures can be round, rectangular and oval holes, the windows in the windowed structures can be rectangular, oval and round, and the denser the number of the through holes or the windows is, the better the heat dissipation effect is. The diameter of boiling bubbles can be effectively reduced, that is, the size of the bubbles is controlled, so that steam columns are prevented from being formed, and therefore the phenomenon of excessive boiling is avoided, the heat flux density of boiling heat transfer can be improved by the perforated or windowed structures formed in the sawtooth pieces, and the capillary force of phase-change heat exchange medium is increased.

The boiling enhancement fins 20 are brazed to the inner wall face of the evaporation chamber 10, so that the contact thermal resistance between the boiling enhancement fins 20 and the evaporation chamber 10 is reduced, and the temperature difference between the boiling enhancement fins 20 and the evaporation chamber 10 is reduced. And compared with technological methods such as micromachining, laser etching and chemical etching, the brazing technology is simpler in technological process, less in brazing equipment investment and higher in processing efficiency.

The evaporation chamber 10 is in direct contact with a heat source, that is, the outer surface of the side wall of the evaporation chamber 10 is in direct contact with the heat source, the outer surface of the evaporation chamber 10 directly replaces the substrate of an existing heat dissipation device so as to improve the heat transfer efficiency between the heat source and the interior of the evaporation chamber 10, and preferably, the outer wall surface of the evaporation chamber is in contact with the heat source and the thickness of the side wall of the evaporation chamber in contact with the heat source is less than 2 mm. The evaporation chamber 10 is preferably a planar plate-shaped body having a cavity therein, the inner cavity of the evaporation chamber 10 is a planar cavity, one side wall of the evaporation chamber 10 is provided with a contact heat absorption surface, the heat source is provided with a planar heat source surface, and the contact heat absorption surface of the evaporation chamber 10 is in contact with the heat source surface of the heat source.

The area of the heat source surface of the heat source is smaller than the area of the contact heat absorption surface of the evaporation chamber 10, and the internal phrase-change heat exchange medium can absorb heat from the heat source by phase-change flow and quickly transfer the heat in two dimensional directions, so that the temperature in the evaporation chamber 10 can be ensured to be uniform.

In the boiling enhancement device of the present invention, the evaporation chamber 10 is used for direct heat dissipation of an electronic device, the heat source is directly installed on the evaporation chamber 10, the phase-change heat exchange medium is not in contact with the heat source, heat is conducted to the boiling enhancement fins 20 through the side wall of the evaporation chamber 10, and the boiling enhancement fins 20 are in contact with both the side wall of the evaporation chamber 10 and the phase-change heat exchange medium.

Therefore, due to the fact that the plurality of densely and evenly distributed sawtooth strip-shaped cooling fins or wavy strip-shaped cooling fins are arranged in the evaporation chamber 10, the structure is beneficial for generating a large number of bubble cores, and the large number of bubble cores can promote the vaporization and boiling of the phase-change heat exchange medium in the evaporation chamber 10. The boiling enhancement fins 20 can promote liquid-gas conversion heat exchange of the phase-change heat exchange medium, so that more heat of the heat source is transferred to the phase-change heat exchange medium in a faster and more uniform manner.

It can be understood that, the present invention is described with reference to some embodiments, and as known by a person skilled in the art, without departing from the working theory and scope of the present invention, various changes and equivalent modifications can be made to these features and embodiments. And, under the guidance of the present invention, these features and embodiments can be modified to adapt to specific circumstances and materials without departing from the working theory and scope of the present invention. Therefore, the present invention is not to be limited by the particular embodiments disclosed herein, and all embodiments falling within the scope of the claims of the present application are intended to be encompassed by the protection scope of the present invention.

The invention claimed is:

1. A boiling enhancement device, comprising an evaporation chamber having a cavity therein and boiling enhancement fins, wherein the boiling enhancement fins are arranged on an inner wall surface of the evaporation chamber, a phase-change heat exchange medium is arranged in the evaporation chamber, and the evaporation chamber absorbs heat from a heat source and transfers the heat to the phase-change heat exchange medium through the inner wall surface; the boiling enhancement fins are configured to increase the number of vaporization cores on the inner wall surface of the evaporation chamber and increase the area of boiling heat exchange so as to promote boiling vaporization of the phase-change heat exchange medium and reduce boiling thermal resistance, the boiling enhancement fins comprise a plurality of sawtooth strip-shaped cooling fins arranged on the inner wall surface of the evaporation chamber, the strip-shaped cooling fins are composed by gathering a plurality of sawtooth sheets, the sawtooth pitch of a minimum repeating unit among the sawtooth strip-shaped cooling fins is less than 1 mm, and the thickness of each of the sawtooth sheets is less than 0.2 mm, windowed structures are formed in the sawtooth strip-shaped cooling fins, and the porosity of the sawtooth strip-shaped cooling fins is smaller than 60% in such a way that the sawtooth strip-shaped cooling fins are densely arranged.

2. The boiling enhancement device according to claim 1, wherein the sawtooth pitch of the minimum repeating unit among the sawtooth strip-shaped cooling fins is 0.0001 mm-1 mm, and the thickness of each of the sawtooth sheets is 0.01 mm-0.2 mm.

3. The boiling enhancement device according to claim 1, wherein the boiling enhancement fins are brazed to the inner wall surface of the evaporation chamber.

4. The boiling enhancement device according to claim 1, wherein the sawtooth strip-shaped cooling fins are triangular sawtooth or rectangular sawtooth strip-shaped cooling fins.

5. The boiling enhancement device according to claim 1, wherein the plurality of strip-shaped cooling fins are arranged in parallel on the inner wall surface of the evaporation chamber.

6. The boiling enhancement device according to claim 1, wherein an outer wall surface of the evaporation chamber is in contact with the heat source, and a thickness of a side wall of the evaporation chamber in contact with the heat source is less than 2 mm.

7. The boiling enhancement device according to claim 6, wherein the outer surface of the side wall of the evaporation chamber is provided with a contact heat absorption surface, the heat source is provided with a heat source surface, and the contact heat absorption surface of the evaporation chamber is in contact with the heat source surface of the heat source.

* * * * *